US005322256A

United States Patent [19]

Kanwischer

[11] Patent Number: 5,322,256

[45] Date of Patent: Jun. 21, 1994

[54] TOOL HOLDER

[76] Inventor: Edmund Kanwischer, 1325 Tanglewood Court, Windsor, Ontario, Canada, N9J 2K3

[21] Appl. No.: 37,415

[22] Filed: Mar. 26, 1993

Related U.S. Application Data

[63] Continuation-in-part of Ser. No. 898,832, Jun. 15, 1992, abandoned.

[51] Int. Cl.[5] ..... A47K 1/08

[52] U.S. Cl. ..... 248/312; 211/65; 211/706; 211/89; 248/113; 248/313

[58] Field of Search ..... 248/312, 313, 316.1, 248/316.2, 110, 111, 112, 113; 211/65, 70.6, 89

[56] References Cited

U.S. PATENT DOCUMENTS

| | | | |
|---|---|---|---|
| 430,138 | 6/1890 | Mee | 211/89 |
| 1,589,818 | 6/1926 | Ritter | 248/113 |
| 1,686,655 | 10/1928 | Ellerbeck | 248/113 |
| 1,864,817 | 6/1932 | Hart | 248/113 |
| 2,051,408 | 8/1936 | Karst | 248/110 X |
| 2,911,172 | 11/1959 | Clayton et al. | 248/113 |
| 2,911,173 | 11/1959 | Deppe | 248/113 |
| 3,091,423 | 5/1963 | Butterworth | 211/70.6 |
| 4,134,499 | 1/1979 | Joswig | 211/66 |
| 4,880,192 | 11/1989 | Vom Braucke et al. | 248/110 |
| 4,909,467 | 3/1990 | Shan-Peo | 248/113 X |
| 5,102,177 | 4/1992 | Dreisig et al. | 294/106 |
| 5,116,003 | 5/1992 | Gerhardt | 248/312 |

*Primary Examiner*—Ramon O. Ramirez

*Attorney, Agent, or Firm*—Pollock, Vande Sande & Priddy

[57] ABSTRACT

A device for holding tools between a pair of jaws which are arranged so that their downward movement also moves the jaws toward each other in a tool gripping position. Downward movement of the jaws is achieved by a combination of weight of the tool and a spring which is arranged on the device to force the jaws downwardly.

12 Claims, 3 Drawing Sheets

TOOL HOLDER

This application is a continuation-in-part of application Ser. No. 07/898,832, filed Jun. 15, 1992, now abandoned.

The present invention relates to a tool holder for storing tools, and more particularly, to a wall-mounted device of the type for storing rakes, shovels, hoses, brooms, and other long-handled implements.

BACKGROUND OF THE INVENTION

A variety of devices have been proposed for holding tools and keeping them in an orderly array. Some of these devices support tools by their heads, while others support tools by their handles. One type of the latter device relies on the weight of the tool to apply a frictional gripping force on a handle. See, for example, U.S. Pat. No. 4,905,951 to Putness which describes a disc-shaped flexible member having an aperture for resiliently gripping a tool handle. See also U.S. Pat. No. 4,134,499 to Joswig which describes a holder having two opposed side walls, one of which has a surface which slopes downwardly toward the other wall, and a gripping roller which is movable along the sloping surface for engaging the tool handle.

Devices such as these are activated only by the weight of the tool being held. It would be desirable to have a tool holder device in which tool-gripping components are urged together not only by the weight of the tool but also by means independent of the tool. It would be most desirable to provide a positive gripping force immediately upon insertion of the tool in the holder, which will hold the tool in place even in the absence of a downward force exerted by the weight of a tool.

SUMMARY OF THE INVENTION

It is accordingly one object of the present invention to provide a tool holder having tool gripping members which are activated by a combination of weight of the tool and an independent mechanism for forcing the gripping members together in a gripping relationship.

It is another object to provide such a tool holder in which the independent mechanism for forcing the gripping members together is readily disengaged from the gripping members.

It is still another object to provide a tool holder with tool gripping members and means for retaining the gripping members in an out-of-the-way position when not in use.

In accordance with the present invention, there is provided a tool holding apparatus comprising a base member for connecting the apparatus to a support member, including two sets of axle support members formed from the base member, and an L-shaped rod member pivotally mounted in each set of the axle support members. Each of the L-shaped rod members comprises an arm segment connected at an inner end portion to an axle segment and at an outer end portion to a jaw member for frictionally engaging a tool. The axle support members are oriented so that the axes of the axle segments intersect each other, and the arm segments cross each other, whereby pivoting the rod members about the axle support members in one direction moves the jaw members together and reversing the pivoting direction moves the jaw members apart. A ring member surrounding the arm segments at their intersection is provided to hold the arm segments in sliding contact with each other. In addition, grip enhancing means are provided for biasing the jaw members together and thus increase the tool holding force of the tool holder, and provide a force biasing the jaw members together in the absence of a tool between the jaws.

In a preferred embodiment, the grip-enhancing means comprises a coil spring mounted on an axle segment of at least one L-shaped rod member having one end secured at the base member and the other end forcing downwardly against the arm segment of that rod member, and adapted for ready disengagement from the arm segment.

In another preferred embodiment the ring member is a coil spring.

In another preferred embodiment, the base member is provided with at least one hook for supporting additional tools.

In still another preferred embodiment, the apparatus comprises a plurality of repeating tool-holding units mounted on an elongated base member.

In yet another preferred embodiment of the present invention, the base member comprises a channel member having a planar support portion, and each axle support member comprises a pair of upwardly-extending parallel lug elements formed from the planar support portion of the channel member.

The tool holder of the present invention provides advantages of (1) increased jaw holding power over that which is typically achieved merely by the weight of the tool, and (2) a positive tool gripping force immediately upon insertion of the tool into the holder, i.e., before the weight of the tool activates forces tending to close the jaws, and (3) the most important improvement is the safety of tools being held by the tool holders.

An upward force on a tool within the jaws causes the tool to slide therein, but also tends to open the grip of the jaws on the tool. In the absence of grip-enhancing means such as a coil spring as described herein, the jaws holding a tool will accidentally be opened and drop the tool. Such an accident could happen if the tool is jostled, such as may happen when removing or inserting another tool in an adjacent tool holder. In the case of a heavy tool, such as a sledge hammer, or the cutting edge of a shovel, this could cause damage or personal injury.

The coil spring in the present invention forces the jaw member toward each other against the tool independently of gripping forces which are applied as a result of the tool weight. If the tool itself is lifted, it merely slides upward within the jaws which retain their grip on the tool. In order to release the tool from the jaws, an upward force sufficient to overcome the downward force exerted by the spring must be applied against the jaws.

DETAILED DESCRIPTION OF THE INVENTION

Figure 1:
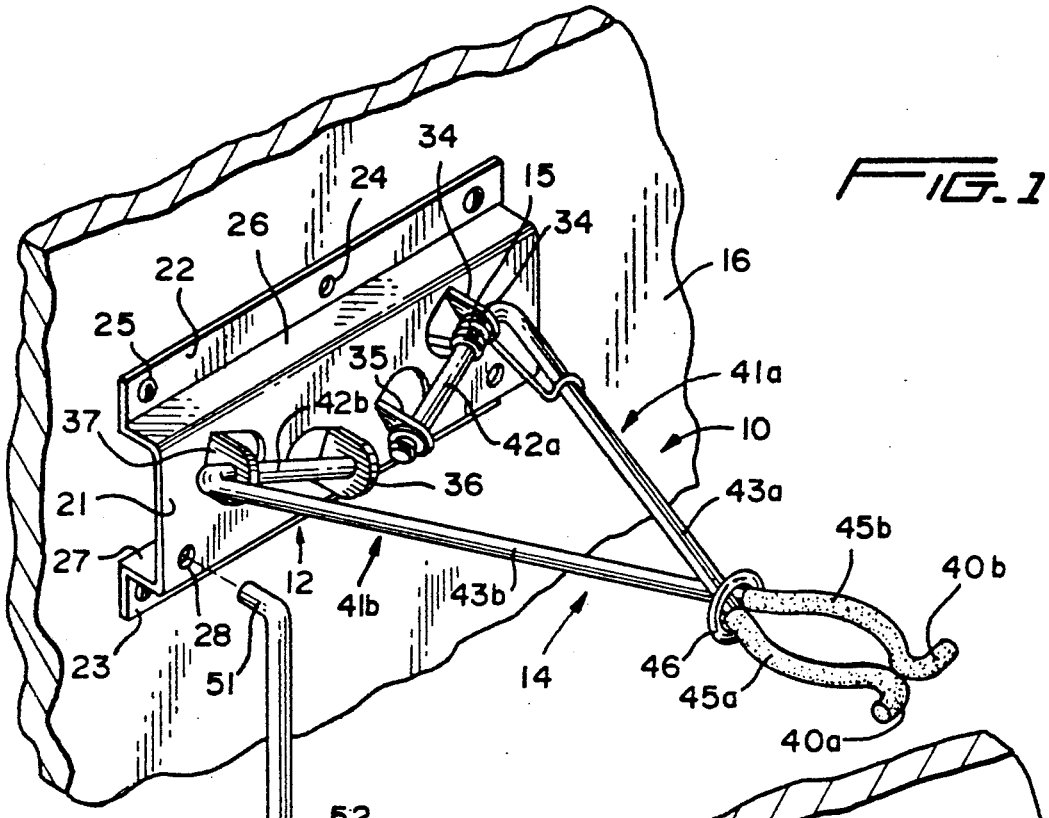
FIG. 1 is a perspective view of the present invention mounted on a wall in a position for gripping a tool.

As shown in the Figures, a tool holder 10 of the present invention comprises a base member 12 for connecting the tool holder 10 to a support member, such as a wall 16; a tool clamping mechanism 14 pivotally mounted on base member 12 for gripping tools; and a grip-enhancing member 15.

As shown in the Figures, in a preferred embodiment of the present invention, base member 12 comprises a channel member having a planar support portion 21, depending side walls 26, 27 and flanges 22, 23 extending outwardly from the side walls. Flanges 22, 23 are provided with holes 24 for securing base member 12 to a vertical support surface such as a wall 16 by fastening elements such as screws 25.

In a preferred embodiment of the present invention, planar support portion 21 is provided with at least one opening 28 for receiving an auxiliary tool holder, such as L-shaped member 50 shown in FIG. 1 which will be described in more detail below.

Figure 3:
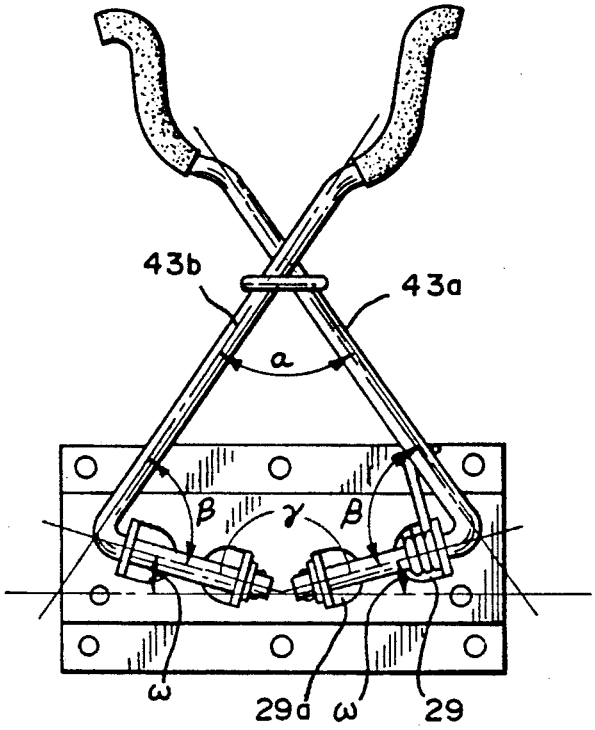
FIG. 3 is a front view of the tool holder of FIG. 1 with the arms in a vertical position.
Figure 4:
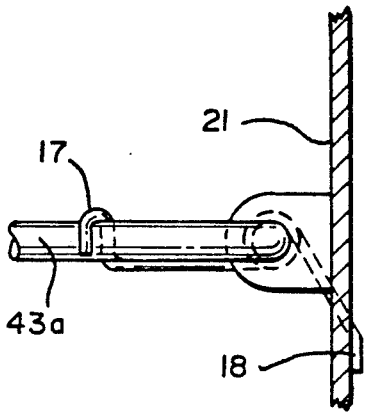
FIG. 4 is an enlarged side view of grip-enhancing means for the present invention.

Axle support members are secured to planar support portion 21 of base member 12. In a preferred embodiment of the present invention, as shown in the Figures, apertured lugs 34, 35 and 36, 37 are formed from and are an integral part of planar portion 21. However, other configurations of axle support members are within the scope of the present invention. For example, each axle support member may comprise a sleeve secured to planar portion 21, as by welding. The axes of the axle support members are parallel to planar support portion 21 and, as shown in FIG. 3, intersect each other at an angle $\gamma$ less than about 160°, preferably at an angle from about 130° to about 160°, and most preferably at an angle from about 140° to about 150°.

Viewing the orientations of the axes of the axle support members from another perspective, the angle $\omega$ between the axes and a horizontal line is at least about 10°, preferably between about 10° and about 25°, and most preferably from about 15° to 20°.

Tool clamping mechanism 14 comprises a pair of substantially L-shaped rod members 41*a*, 41*b* having arm segments 43*a*, 43*b*, jaw members 45*a*, 45*b*, and axle segments 42*a*, 42*b*. Arm segments 43*a*, 43*b* are loosely held together by ring member 46 in a sliding, crossing relationship. Rod members 41*a*, 41*b* will be described in detail with respect to rod member 41*a*.

Rod member 41*a* comprises a straight, cantilevered arm segment 43*a* joined at one end to a straight axle segment 42*a*, and at the other end to jaw member 45*a*. Axle segment 42*a* is pivotally mounted in an axle support member comprising apertured lugs 34, 35. Arm segment 43*a* and axle segment 42*a* must be joined at an angle $\beta$ less than 90° and in a preferred embodiment of the present invention, arm segment 43*a* and axle segment 42*a* are joined at an angle $\beta$ from about 50° to about 80°, and most preferably at angle $\beta$ of about 60°.

Angles $\beta$ and $\gamma$ are fixed; however, angle $\alpha$ changes as the arms move from a vertical to a horizontal position. When the tool holder is in a tool holding position with arm segments in a horizontal position as shown in FIG. 1, the arm segments cross at an acute angle for $\alpha$, e.g., at an angle from about 65° to about 75°. However, when the arm segments are in the vertical position as shown in FIG. 2, the segments cross at an angle $\alpha$ of about 85° to about 95°. When the point at which the arms cross is in the plane of axle segments 42*a*, 42*b*, the sum of angles $\alpha$, $2\beta$, and $\gamma$ is 360°.

Figure 9:
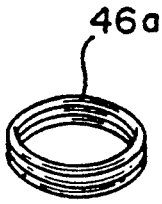
FIG. 9 is an isometric view of a coil spring for use as a ring member.

The increase in angle $\alpha$ in moving the arm segments from a horizontal to a vertical position changes the clearance between the inner surface of ring 46 and the outer surfaces of arm segments 43*a* and 43*b*. In a preferred embodiment of the present invention, advantage is taken of this change in clearance. In this embodiment, a coil spring 46*a*, as shown in FIG. 9, is substituted for ring 46. The coil spring, which preferably has from about 4 to about 6 turns, has an internal diameter dimensioned to loosely surround the arm segments 43*a*, 43*b*, when the arms are in a horizontal, tool-holding position, and to tightly hold the arms together when the arms are in a vertical position. A coil spring having an internal diameter from about 2.25 to about 2.5 times the diameter of an arm segment has been found to be a useful size. For example, a coil spring may have an internal diameter from about 7/16 inch to about ½ inch to hold together a pair of arms, each having a diameter of 3/16 inch. In order to retain the arms in a vertical storage position, it is necessary to disengage spring 15.

The spring is under the greatest tension when the arms are in a position at which the intersection of the arms is in the plane of axle members 42*a*, 42*b*. At this point, as has been taught, the sum of angles $\alpha$, $\gamma$ and two angles $\beta$ is 360°. A slight force is thus needed to rotate the arms away from the storage position against wall 16 to the vertical position. The spring 46*a* thus tends to hold the arms in the storage position against wall 16.

Jaw member 45*a* has a reverse curvature including an inwardly facing concave portion and an outwardly extending end portion 40*a* which permits a tool to be inserted between the jaw members from the side by pressing the tool against the end portions. In a preferred embodiment, jaw members 45*a*, 45*b* comprise a resilient material, such as a plastic, as a contact surface.

While the rod member 41*a* may have a slightly different configuration than 41*b*, in a preferred embodiment, rod members 41*a* and 41*b* are identical and thus interchangeable.

Figure 7:
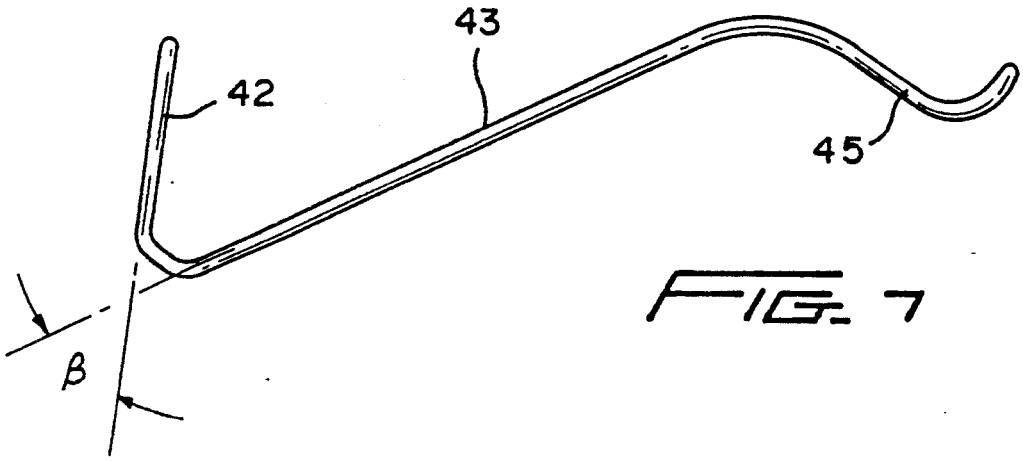
FIG. 7 is a plan view showing the configuration of the L-shaped rod member in a preferred embodiment of the present invention.
Figure 8:
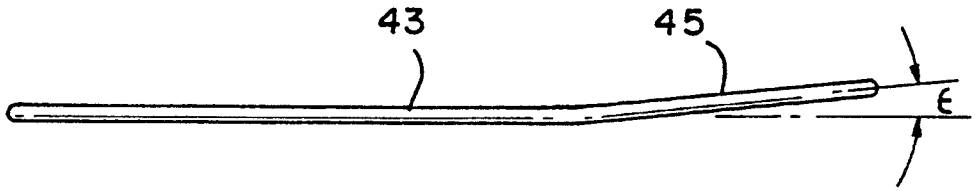
FIG. 8 is a view in elevation of the rod member shown in FIG. 7.

Interchangeability of these parts reduces the inventory of parts needed in the assembly and simplifies the step of assembling the components. FIGS. 7 and 8 show a configuration which is particularly well-suited for a tool holder having identical arms. As shown, portions 42 and 43 are substantially in one plane and the jaw portion 45 extends upwardly at an angle $\epsilon$ from the plane defined by portions 42 and 43. The angle $\epsilon$ between jaw member 45 and the plane defined by portions 42 and 43 permits the arms in the assembly to cross and yet have jaw members 45 be properly aligned for holding tools. The outer end of jaw member 45 is above the plane defined by arm portions 42 and 43 a distance of about ½ to 1½ times the diameter of arm segment 43. For an arm segment having a diameter of 3/16 of an inch a useful angle $\epsilon$ is about 4° to about 6°.

Grip-enhancing means comprises coil spring member 15 which is mounted on axle segment 42*a*. Spring member 15 has an end portion 18 inserted into aperture 29 in planar portion 21 of base member 12. An opposite end portion 17 is hooked over arm segment 43*a*, forcing rod member 41*a* in a downward pivoting motion, thus bringing the jaws 45*a*, 45*b* together. Ring member 46 forces arm segment 43*b* to move in the same direction as arm segment 43*a*.

Figure 6:
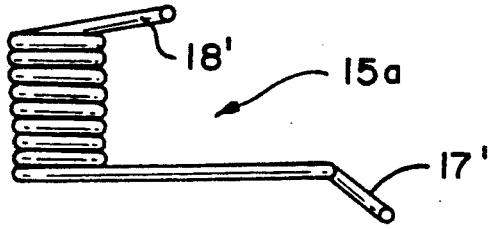
FIG. 6 is a view in elevation of a preferred embodiment of a coil spring used as a grip-enhancing means.

While the Figures show a spring member 15 only on one rod member, a spring may be placed on each rod member or on 41*b* instead of on 41*a*. In the embodiment shown in FIG. 1 having 3 to 4 turns, the spring member is designed to apply a force of at least about 7 pounds downwardly on the rod member 41*a* when the jaws are in a closed position, and preferably is capable of providing a downward force of about 8 to about 10 pounds. In one preferred embodiment shown in FIG. 6, the spring is provided with at least about six turns and preferably about 8 to 9 turns and is designed to apply a downward force from about 5 to about 6 pounds. In order to fit a spring of such length on axle segment 42*a*, it may be necessary to insert end portion 18 in aperture 29*a* rather than in aperture 29 as shown.

Figure 2:
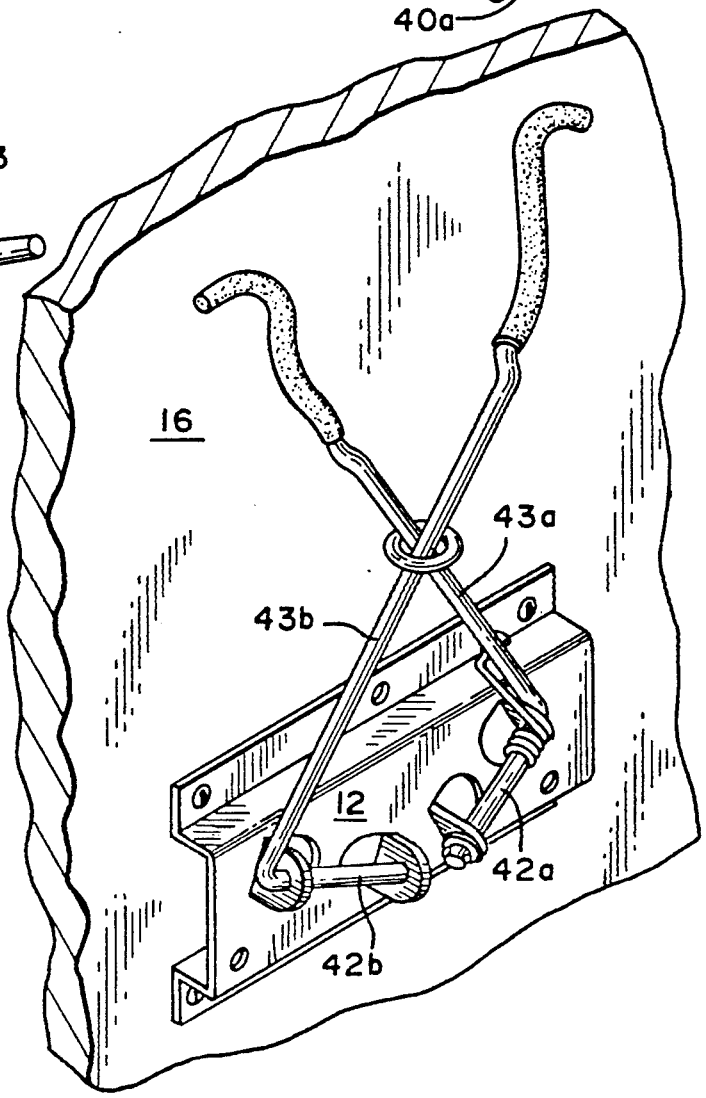
FIG. 2 is a perspective view of the device shown in FIG. 1 showing gripping members in an open position.

In a preferred embodiment of the present invention, base member 12 is provided with at least one hole 28 and preferably two holes in planar support portion 21 to accommodate a supplemental hook 50 as shown in FIG. 1. As shown therein, hook 50 comprises a substantially L-shaped member having a short upper horizontal stem 51 for support within opening 21, a depending leg 52; and an arm 53 at right angles to leg 52 for supporting tools. Means, such as a deformed segment, is provided at the end of stem 51 for retaining hook 50 on base member 12.

Figure 5:
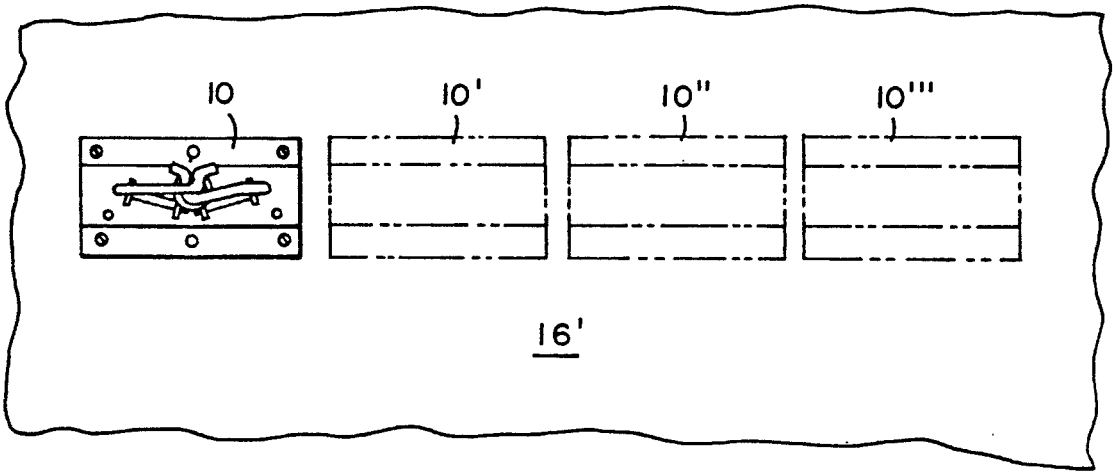
FIG. 5 is a front view of a plurality of tool holding devices arranged side by side in one channel.

As shown in FIG. 5, a plurality of tool holders 10, 10', 10'' and 10''' may be mounted on a support surface 16'. In a preferred embodiment, an elongated channel member is provided with a plurality of pairs of axle support lugs for pivotally mounting a plurality of tool-gripping jaws.

Having thus described the present invention, the following example is offered to illustrate it in more detail.

EXAMPLE

A tool holder which is constructed in accordance with the Figures has a base member 12 formed of 0.045 inch sheet metal. Upstanding lugs with apertures as shown are formed from planar support portion 21 to provide axle support members which have axes which cross each other at an angle $\gamma$ of about 145°. L-shaped rod members are formed from a 3/16 inch rod to provide an angle $\beta$ of about 60° at the intersection of arm segment 43*a* and axle segment 42*a*. A coil spring 15*a* having 9 turns is formed from 0.0625 inch wire, is mounted on axle segment 42*a*, and exerts a downward force of about 8 pounds on arm 43*a*. A five turn coil spring formed from wire about 0.045 inch in diameter, and having an internal diameter of about 7/16 inch as shown in FIG. 9 is used as the ring to hold the arms 43*a* and 43*b* together. In a completely open position, as shown in FIG. 2, arms 43*a*, 43*b* intersect each other at an angle of about 90° and in a closed position, as shown in FIG. 1, the angle of intersection of arm 43*a* with arm 42*a* is about 70° to 75°.

What is claimed is:

1. Apparatus for holding tools comprising:

a base member for connecting said apparatus to a support member, first and second axle support means secured to said base member, and first and second substantially L-shaped rod members, each rod member having an axle segment pivotally mounted, in one of said axle support means, and an arm segment connected at an acute angle to its axle segment and cantilevered outwardly from said base member, each of said arm segments having an outer portion comprising a jaw member for frictionally engaging a tool, wherein:

(a) said base member comprises a channel member having an outer planar support portion, and each of said first and second axle support means comprises a pair of lugs formed from and extending outwardly from said planar surface, said lugs in each pair being parallel to each other and each lug being provided with an axial aperture;

(b) said first and second axle support means are oriented so that the axes of said axle segments intersect each other, and said arm segments cross each other, whereby pivoting said first and second rod members about said first and second axle support means in a first rotational direction moves said jaw members together in a tool holding position and reversing the pivoting direction moves said jaw members apart to release said tool;

(c) means are provided for holding said air segments of said first and second rod members in sliding contact with each other; and, (d) grip enhancing means are provided for biasing said jaw members together for increasing the tool holding force of said apparatus, said grip enhancing means comprising a coil spring mounted on at least one of said axle segments, said coil spring having a first end portion secured in a fixed position on said base member and a second end portion connected to the arm segment of the rod member on which the spring member is mounted for urging said jaw members downwardly and inwardly toward each other in a tool holding position.

2. Apparatus according to claim 1 wherein the formation of said lugs from said planar surface produces apertures in said surface, and said first end portion of said coil spring is secured in one of said apertures.

3. Apparatus according to claim 1 wherein said coil spring is adapted to provide a force of at least about 7 pounds against said arm segment.

4. Apparatus according to claim 2 wherein said coil spring comprises a coil having from about 6 to about 9 turns of wire having a diameter from about 0.060 inch to about 0.065 inch.

5. Apparatus according to claim 1 wherein said first and second axle support means are oriented so that the axes of the axle segments of said first and second L-shaped rod members intersect each other at an angle of less than about 160°.

6. Apparatus according to claim 1 wherein said first and second axle support means are oriented so that the axes of the axle segments of said first and second L-shaped rod members intersect each other at an angle from about 130° to about 160°.

7. Apparatus according to claim 1 wherein said first and second axle support means are oriented so that the axes of the axle segments of said first and second L-shaped rod members intersect each other at an angle from about 140° to about 150°.

8. Apparatus according to claim 1 wherein, for each rod member, said axle segment intersects said arm segment at an angle from about 50° to about 80°.

9. Apparatus according to claim 1, wherein said means for holding said arm segments in sliding contact with each other comprises coil spring means dimensioned to loosely surround said arm segments when in a tool holding position and tightly surround said arm segments when said arm segments are extending vertically from said axle support means.

10. Apparatus for holding tools comprising:

a base member for connecting said apparatus to a support member, said base member comprising a channel member having an outer planar support portion;

first and second axle support means formed from said planar support portion, said first and second axle support means having first and second axes respectively, said axes being oriented to intersect each other at an angle from about 130° to about 160°;

first and second substantively L-shaped rod members, each of said rod members comprising a straight axle segment pivotally mounted in one of said axle support means, and an arm segment connected to said axle segment at an angle between about 50° and about 80°, said arm segment having an outer portion including a jaw member for frictionally engaging a tool;

a first coil spring enclosing both of said arm segments at their intersection for holding said arm segments of said first and second rod member in sliding, crossing contact with each other, said coil spring having an internal diameter selected to loosely hold said arm segments together when said jaw members are in a tool holding position and tightly hold said arm segments together when said arm segments are in a vertical position;

a second coil spring mounted on at least one axle segment of a rod member for forcing said arm segments downwardly to bias the jaw members of said first and second rod members together for increasing the tool holding forces thereof, said spring member having a first end portion secured in an aperture on the planar portion of on said base member and a second end portion connected to the arm segment of the rod member on which the spring member is mounted for urging said jaw members downwardly and inwardly toward each other.

11. Apparatus according to claim 10 wherein said first coil spring has an internal diameter from about 2.25 to about 2.5 times the diameter of an arm segment.

12. Apparatus according to claim 10 wherein the jaw members of each of said L-shaped rod members intersects a plane defined by said axle segment and said arm segment at an angle $\epsilon$ from about 4° to about 6°.

* * * * *

UNITED STATES PATENT AND TRADEMARK OFFICE

CERTIFICATE OF CORRECTION

PATENT NO. : 5,322,256

DATED : June 21, 1994

INVENTOR(S) : Edmund Kanwischer

It is certified that error appears in the above-indentified patent and that said Letters Patent is hereby corrected as shown below:

In column 6, line 27, change "air" to —arm—

Signed and Sealed this

Twentieth Day of September, 1994

*Attest:*

Bruce Lehman

BRUCE LEHMAN

*Attesting Officer*

*Commissioner of Patents and Trademarks*